US007217332B2

(12) United States Patent
Brown, Jr. et al.

(10) Patent No.: US 7,217,332 B2
(45) Date of Patent: May 15, 2007

(54) BRUSH FILAMENT BUNDLES AND PREPARATION THEREOF

(75) Inventors: William R. Brown, Jr., Peabody, MA (US); Joseph A. Depuydt, Quincy, MA (US); Daniel C. Portman, South Attleboro, MA (US); Helge Zimmet, Waltham, MA (US)

(73) Assignee: The Gillette Company, Boston, MA (US)

( * ) Notice: Subject to any disclaimer, the term of this patent is extended or adjusted under 35 U.S.C. 154(b) by 623 days.

(21) Appl. No.: 10/238,285

(22) Filed: Sep. 10, 2002

(65) Prior Publication Data

US 2004/0048063 A1 Mar. 11, 2004

(51) Int. Cl.
*B32B 37/00* (2006.01)

(52) U.S. Cl. ..... 156/73.2; 156/73.1; 156/296; 156/308.4

(58) Field of Classification Search ..... 156/73.1, 156/73.2, 73.3, 296, 308.2, 308.4, 433, 580.1, 156/580.2, 93, 290
See application file for complete search history.

(56) References Cited

U.S. PATENT DOCUMENTS

| | | | | |
|---|---|---|---|---|
| 2,887,340 | A | 5/1959 | Veneko | 300/21 |
| 4,462,136 | A | 7/1984 | Nakao et al. | 15/167 R |
| 4,498,708 | A | 2/1985 | Bromboz | 300/2 |
| 4,609,228 | A | 9/1986 | Bickel | 300/4 |
| 4,678,113 | A | 7/1987 | Bridges et al. | 228/160 |
| 4,697,851 | A | 10/1987 | Takahashi | 300/1 |
| 4,807,938 | A | 2/1989 | Weihrauch | 300/21 |
| 4,884,849 | A | 12/1989 | Shaw | 300/4 |
| 5,133,590 | A | 7/1992 | Fitjer | 300/21 |
| 5,344,218 | A | 9/1994 | Weihrauch | 300/2 |
| 5,439,720 | A * | 8/1995 | Choudhury | 428/36.9 |
| 5,458,400 | A | 10/1995 | Meyer | 300/21 |
| 5,765,927 | A | 6/1998 | Lewis, Jr. | 300/21 |
| 6,290,303 | B1 | 9/2001 | Boucherie | 300/5 |
| 6,578,929 | B2 | 6/2003 | Motherway et al. | 300/2 |
| 2003/0104161 | A1 * | 6/2003 | Edwards | 428/85 |

FOREIGN PATENT DOCUMENTS

| | | |
|---|---|---|
| EP | 1302127 A2 | 4/2003 |
| EP | 1302127 A3 | 11/2003 |
| FR | 2797755 A1 | 3/2001 |

* cited by examiner

*Primary Examiner*—James Sells
(74) *Attorney, Agent, or Firm*—Fish & Richardson P.C.

(57) ABSTRACT

Methods and devices are provided for forming filament bundles of long, continuous strands of filaments. The methods include bonding the long, continuous stands of filaments together so that they cannot move axially with respect to any other filament in the bundle. Methods of bonding include ultrasonic welding, freezing or applying adhesive.

19 Claims, 8 Drawing Sheets

BRUSH FILAMENT BUNDLES AND PREPARATION THEREOF

TECHNICAL FIELD

This invention relates to brush manufacturing, and more particularly to filament preparation.

BACKGROUND

Conventional toothbrushes generally include tufts of bristles mounted on the head of an oral brush handle. One method of manufacturing toothbrushes involves placing tufts of finished (end-rounded) bristles so that their unfinished ends extend into a mold cavity, and forming the toothbrush body around the unfinished ends of the tufts by injection molding, thereby anchoring the tufts in the toothbrush body. The tufts are held in the mold cavity by a mold bar having blind holes that correspond to the desired positioning of the tufts on the finished brush. The finished bristles may be formed by a process that includes unwinding a rope of filaments from a spool, end-rounding the free end of the filaments, cutting off a portion of the rope that is adjacent the free end of the filaments to form bristles having the desired length, and placing the bristles into a rectangular box, called a magazine. Tufts are then formed by picking groups of bristles from the magazine.

However, problems often occur when bristles are picked from the magazine and transferred to the machine that fills the moldbar. A picker device attempts to repeatedly choose the proper number of bristles to form a tuft. However, the inherent difficulty in this task may result in tufts of bristles that are either too small or too large for the blind holes in the moldbar. If a tuft is too small, the blind hole is not sufficiently filled and plastic will flow into the hole when the handle is formed. If a tuft is too large, one or several bristles may not enter the moldbar, but rather curl to the side and prevent the complete insertion of the tuft into the moldbar, which may then interfere with molding.

These problems can be addressed by filling the moldbar with continuous filament bunches supplied directly from spools. Methods and machines used to fill moldbars from a continuous filament stream is described in U.S. patent application Ser. No. 09/863,193, entitled TUFTING ORAL BRUSHES, the disclosure of which is incorporated herein by reference. Toothbrushes using these methods can be manufactured relatively easily and economically by an injection molding process that includes advancing free ends of strands of continuous filaments into a moldbar. The filaments are not cut to bristle-length until after the free ends of the filaments have been advanced into the holes in the moldbar, thus reducing or eliminating the problems that tend to occur when handling cut tufts, as discussed above.

Problems may arise, however, when supplying the spool fed tufting machine due to catenary problems inherent in the spools of continuous filaments. Problems include non-uniform tension and length between individual filaments, which are generally the result of the filament manufacturing process. These tension and length differentials may cause individual filaments to eventually loop as the filament bundle is pulled from the spool, as shown in FIGS. 1A–1D, or wrap around the bundle, as shown in FIG. 2.

When these problems occur, the dimensions of the filament bundle entering the feeding device of the spool fed tufting machine may vary. For example, when filaments twist around each other, the diameter of the entire bundle increases. Since the tolerances on the feeding device are generally tight, the area of the bundle with the increased diameter may not fit into the feeding device. The area of increased diameter also may not fit into the blind holes of the moldbar.

Further, when individual filaments have little tension, those filaments tend to slide axially relative to the other filaments, back in the direction of the spool during feeding. As the individual filament continues to be moved back towards the spool, and the slack increases, a loop may eventually form. This loop may eventually snag or break the filament.

SUMMARY

The inventors have found that these catenary problems can be reduced or even eliminated by inhibiting or preventing movement of the filaments relative to each other.

One method of preventing the filaments from moving relative to each other is to weld the filaments to each other at spaced intervals. This welding process can be done, for example, just prior to the bundle entering the feeding device, or in a pre-manufacturing step in which the bundle is welded and re-wound onto spools that are then supplied to the tufting machine. Welding the filaments in the bundle to one another prevents the filaments from moving relative to each other, either axially or radially around each other. By preventing axial movement, the individual filaments cannot move back towards the spool, thereby preventing loops from forming. By preventing movement radially around each other, the individual filaments cannot wrap around the bundle, thereby preventing diameter changes. Further, since the filament bundle can be cut so as to have the weld placed in the mold cavity when the toothbrush handle is formed, the weld can be shaped, or a hole can be formed in the weld, to form an anchor. By using the weld to form an anchor, one can eliminate the separate step of forming anchors by heating the filament bundles in the moldbar and "mushrooming" the ends, as is well known in the art.

Another method of preventing the filaments from moving relative to each other is to temporarily bond the filaments to each other using a soluble adhesive. The adhesive could be applied either in a pre-manufacturing step or just prior to the filament bundle entering the feeding device. Once the brush handle has been formed, the soluble adhesive is removed from the exposed bristles.

A further method of preventing the filaments from moving relative to each other is to temporarily bond the filaments to each other using ice. A liquid is applied to the filament bundle and the bundle is passed through a stream of chilling liquid or gas, such as liquid nitrogen. The liquid nitrogen will instantly freeze the bundle into a solid rod, which will then easily slide through the feeding device. The ice can then be melted, such as by heating in the tufting machine or the by the frictional heating of the filaments during the end rounding process.

In one aspect, the invention features a method for manufacturing filament bundles including: (a) feeding a bundle comprising a plurality of long, continuous strands of filaments through a bonding device; and (b) forming at least one bond between the plurality of continuous strands of filaments, wherein forming the at least one bond between the plurality of continuous strands of filaments prevents the filaments from moving axially with respect to any other one of the plurality of continuous strands of filaments.

Some implementations include one or more of the following features. The method further includes forming a plurality of bonds axially spaced along the filament bundle.

The plurality of bonds are equally spaced axially along the filament bundle. The bonds are formed by welding. The welding may be accomplished by ultrasonic welding. The ultrasonic welding is done by using a horn and anvil. The anvil includes a metal base, a channel running through the metal base through which the filament bundle passes, and non-metallic walls lining the sides of the channel to prevent the horn from welding to the anvil. The horn and anvil together will form the shape of a final brush tuft. The width of the channel is adjustable. The horn is a bar horn. The ultrasonic welding is accomplished by an ultrasonic sewing device.

In another aspect, the invention includes shaping the bond to a finished tuft shape. The bond may be shaped to include an undercut. The bond may be shaped to include a hole through the bond. The method further includes tensioning the filament bundle before forming the bond.

In a further aspect, the invention includes forming an axially continuous bond. In one aspect, the axially continuous bond is formed by freezing the filament bundle. The filament bundle is frozen by (a) applying a liquid to the filament bundle to wet the filaments; and (b) applying a material that causes rapid freezing to the wet filaments to freeze the liquid. The material that causes rapid freezing is liquid nitrogen. In another aspect, the axially continuous bond is formed by apply adhesive to the filament bundle. The adhesive is water soluble. The method of applying adhesive to the filament bundle further includes removing the adhesive after the filament bundle has been fed through a tufting machine.

In another aspect, the invention includes forming a toothbrush by (a) feeding a bundle comprising a plurality of long, continuous strands of filaments through a bonding device; (b) forming bonds between the plurality of continuous strands of filaments, wherein the bonds are equally spaced axially along the bundle; (c) feeding the bundle into a tufting machine; wherein the tufting machine advances the plurality of continuous strands of filaments into a moldbar; (d) cutting the bundle adjacent the bonds so that the bonds extends above a surface of the moldbar; (e) placing the moldbar in a molding machine so that the bonds extend into a mold cavity defined in part by the moldbar, the mold cavity being shaped to form the body of the toothbrush; and (f) delivering resin into the mold cavity to form a toothbrush body around the bonds. The method further includes forming an opening in each bond so that the resin delivered into the mold cavity flows through the opening. The method also includes forming an undercut in each bond so that the resin delivered in to the mold cavity flows into the undercut. The bundle is cut adjacent the bonds so that the bonds extend into a blind hole in the moldbar, below the surface of the moldbar. The bonds are equally spaced axially along the bundle at a distance less than the distance equal to a tuft length on a finished brush.

In a further aspect, the invention includes winding the bundle onto a spool after forming the bonds and supplying the bonded bundle to the tufting machine from the spool. The step of forming the bonds is done by ultrasonic welding.

In a further aspect, the invention features a continuous filament bundle for use in a spool-fed tufting machine comprising: (a) a plurality of long, continuous strands of filaments; and (b) at least one bond between the plurality of continuous strands of filaments, wherein the at least one bond between the plurality of continuous strands of filaments prevents the filaments from moving axially with respect to any other one of the plurality of continuous strands of filaments. The filament bundle includes a plurality of bonds spaced axially along the filament bundle. The bonds are equally spaced axially along the filament bundle. The bond is a weld. The weld is an ultrasonic weld. The bond is shaped like the finished tuft. The bond includes an undercut. The bond includes a hole through the bond. The bond is an axially continuous bond. The axially continuous bond is formed by freezing the filament bundle.

Another aspect of the invention includes an ultrasonic welding device including (a) an anvil comprising a metal base with a top surface and a channel in the metal base along the top surface that defines at least a portion of a shape of a tuft through which a filament bundle passes, the channel having two side walls and a bottom; and (b) a horn that moves relative to the anvil, wherein the horn can be moved into and out of contact with the filament bundle in the channel. The ultrasonic device includes one or more of the following feature. The horn forms at least a portion of the shape of the final tuft. The channel further includes non-metallic walls lining the side walls of the channel. The non-metallic walls have a higher melting point than the filament bundles. The non-metallic walls can be either polyether-imide, polyether-ether-ketones, polysulfones, fluoropolymer, polytetrafluorethylene (Teflon®), phenolic resin, rubber, epoxy, ceramic materials and hardwood. The anvil further includes spring loaded slides adjacent the channel that constrain the filament bundle and move with the horn as the horn makes contact with the spring loaded slides and moves into contact with the filament bundle in the channel. The spring-loaded slides are non-metallic. The side walls of the channel are adjustable relative to each other to adjust the width of the channel.

Other aspects include the device having a bar horn. The horn forms an opening through the bond. The horn forms an undercut in the bond. The anvil forms an opening in through the bond. The anvil forms an undercut in the bond.

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 3:
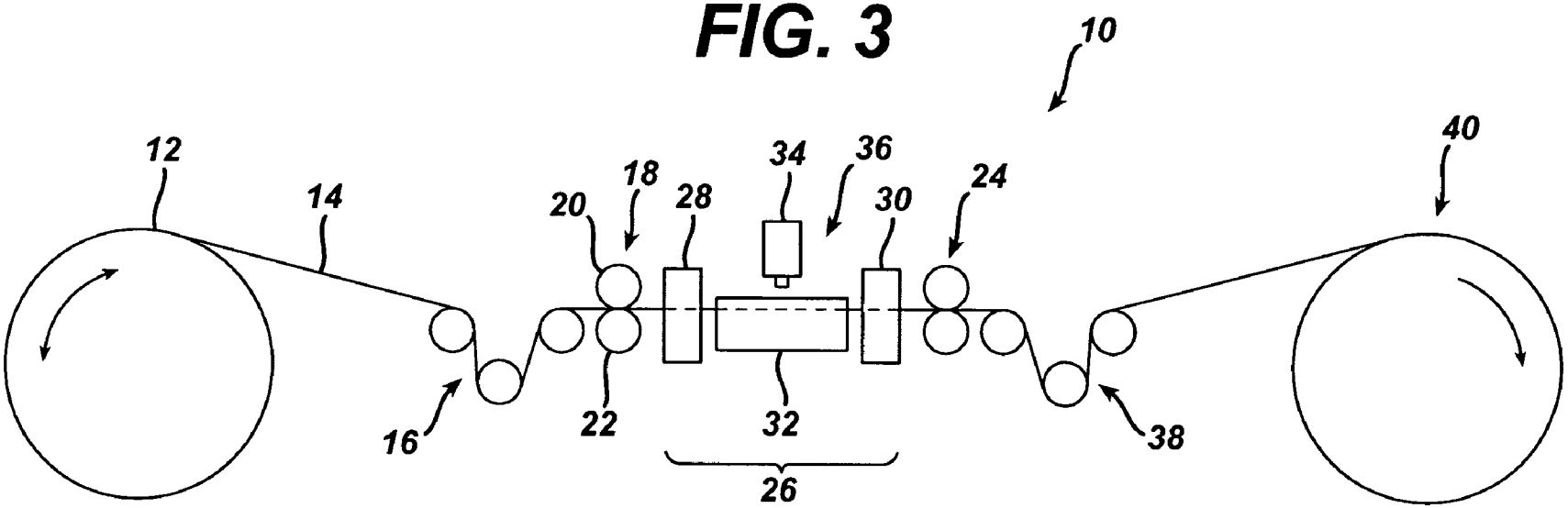
FIG. 3 is a schematic view of a welding process according to one embodiment of the invention.

A process for ultrasonic welding of a filament bundle generally includes the following steps, which will be discussed briefly now, and explained in further detail below. Generally referring to FIG. 3, a welding setup 10 is supplied by a pay-off spool 12 containing a filament bundle 14, the bundle corresponding in number of filaments to a tuft on a finished toothbrush. The filament bundle 14 is fed through a tensioning device 16, which is generally known in the art and in the textile art. Next, the filament bundle 14 goes through a decoupling device 18, which consists of nip rollers 20 and 22. The decoupling device 18, in conjunction with a second decoupling device 24, holds the filament bundle 14 in place while in the welding area 26. The filament bundle 14 is pulled through a shaping block 28, which forms the filament bundle into the shape of a tuft on a finished toothbrush. A second shaping block 30 helps hold the filament bundle in the desired shape as the filament bundle passes through the anvil 32 of the welding device 36.

The welding device 36 is preferably an ultrasonic welding set up with a custom anvil 32 and horn 34. The shape of the anvil and horn, which will be described more fully below, corresponds to the shape of the tuft on a finished toothbrush. While the decoupling devices 18 and 24 hold the filament bundle 14 and prevent it from moving, the horn 34 of the welding device 36 engages the filament bundle in the anvil 32 and ultrasonically welds the individual filaments 52 in the filament bundle 14 together. The resultant weld 50 (shown in FIG. 4) will have the cross-sectional shape of the final tuft on the finished toothbrush.

The filament bundle 14 exits the weld area 26 through the second decoupling device 24, The filament bundle is then fed through an advancing mechanism 38, which indexes the filament bundle forward and locks during the actual welding step. The advancing mechanism only rotates in one direction, so as to allow the filament bundle to advance forward, and prevent the filament bundle from slipping backwards towards the welding area 26. The filament bundle is generally advanced in an indexing fashion a distance T (see FIG. 4), which will vary depending on the final tuft length for the brush being manufactured from the filament bundle, and other welds (e.g., welds 54 and 56) are formed after each indexing movement. Finally, the finished filament bundle 14 is wound onto spool 40, which is then supplied to a tufting machine.

Figure 4:
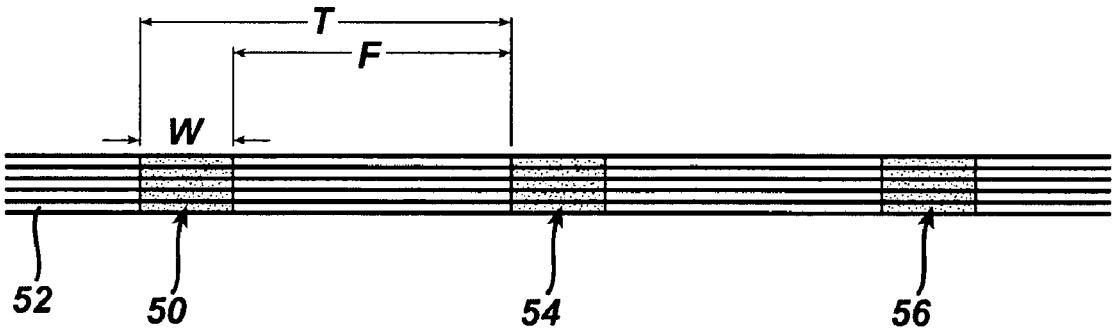
FIG. 4 is a side schematic view of a filament bundle welded in accordance with an embodiment of the invention.
Figure 4A:
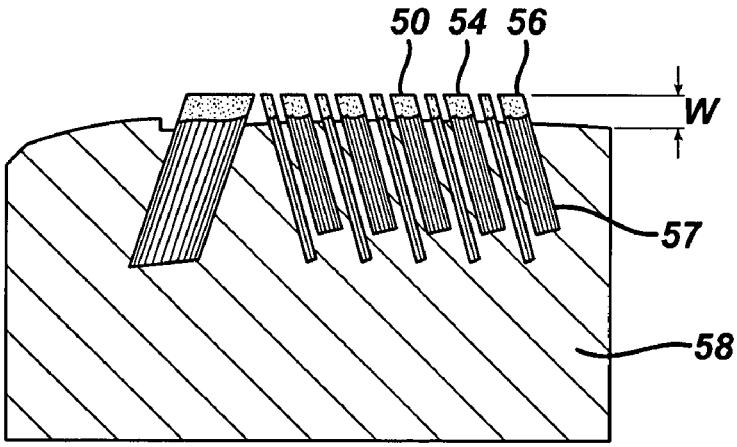
FIG. 4A is a cross-sectional view of the filament bundles in a mold bar in accordance with an embodiment of the invention.

Referring to FIGS. 4 and 4A, the welds 50, 54, 56 are generally spaced such that a length F is left unbound between welds. Length F is equal to the length of the working, free-end of the tuft that will be pushed into the blind holes 57 of the moldbar 58, as described in application Ser. No. 09/863,193. The weld length W is generally equal to the amount of tuft that will extend into the mold cavity and will therefore be embedded into the finished toothbrush handle. The total length T of the tuft is equal to the weld length plus the free-end of the tuft. These lengths can be adjusted for each filament bundle depending on the finished tuft that the filament bundle will be used to manufacture.

The Tensioning Device

Figure 1A:
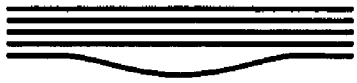
FIGS. 1A–1D are sequential side views of a filament bundle with one filament looping upon itself.
Figure 1B:
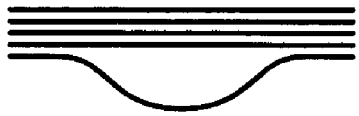
Figure 1C:
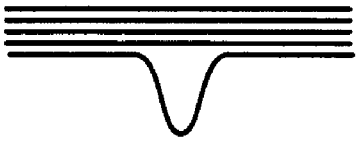
Figure 1D:
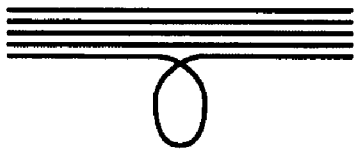
Figure 2:
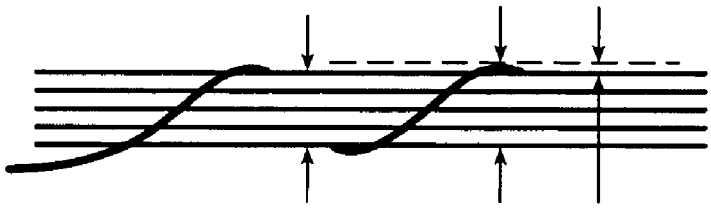
FIG. 2 is a side view of a filament bundle with one filament twisting around the bundle.

The tensioning device 16 is used in conjunction with the pay-off spool 12 to pull on the filament bundle. The pay-off spool can move in either direction to help the tensioning device keep a constant tension on the filament bundle 14. Tension will tend to stretch the shorter filaments to a length closer to the longer filaments, helping to lessen the amount of slack that builds as the filament bundle is released from the pay-off spool and, thereby, lessening the possibility of the longer filaments looping. The tension will also help keep the shape of the filament bundle in the welding area 26 by not allowing any filaments to bow out of the filament bundle as shown in FIG. 1A or 1B. The necessary tension will vary depending on the number and diameter of filaments in the filament bundle. For example, a nail tuft with 37 filaments, each filament having a 0.008 inch diameter, requires approximately 4 lbs. of tension. A tuft of 139 filaments with the same type of filaments requires approximately 10 lbs. of tension.

The Horn and Anvil

Figure 5:
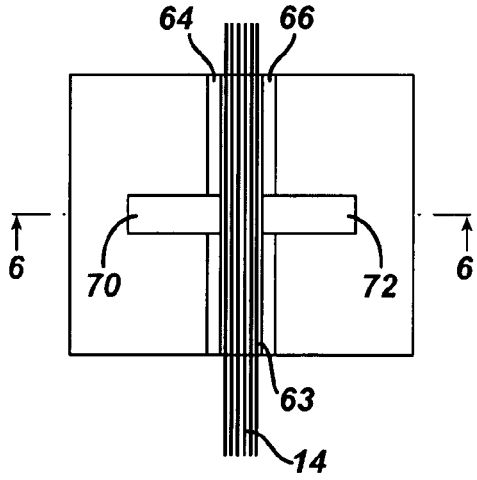
FIG. 5 is a top view of an ultrasonic welding anvil according to one embodiment of the invention.
Figure 6:
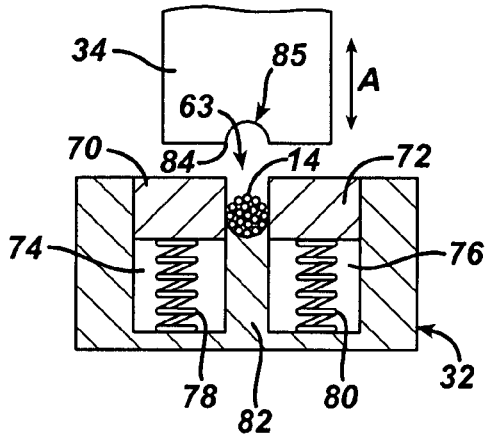
FIG. 6 is a cross-sectional view of the ultrasonic welding anvil of FIG. 5 taken along line 6—6 and its associated ultrasonic welding horn.

Referring to FIGS. 5 and 6, the anvil 32 includes a channel 63 through which the filament bundle 14 passes. Ultrasonic welding causes heating and plastic flow in the thermoplastic filaments by passing high frequency waves from a metallic horn 34, through the thermoplastic filaments and into the metallic anvil 32. While flow is desirable within the filament bundle and between individual filaments to bond them together, tight tolerances between the horn and anvil are necessary to prevent undesirable flow into the clearance between the horn and anvil, which would cause flash on the fused area. Flash would include overflow outside of the desired shape of the weld that would not allow the weld to pass through the feeding device of the tufting machine. To avoid such flash, the clearance between the horn and anvil must be extremely small, preferably less than 0.0005 inches. However, if the metal horn touches the metal anvil, the ultrasonic waves will cause the horn to weld to the anvil. Because of the difficulty in aligning the horn and anvil when only 0.0005 inches of clearance are desirable, the anvil can be fitted with non-metallic walls 64 and 66 (96 and 98 in FIG. 7). The non-metallic walls are preferably a plastic material, such as Teflon, with a higher melting point than the filaments, which are usually nylon or polybutylene terephthalate (PBT). Other possible materials for the non-metallic walls include engineering polymers such as polyether-imide and polyether-ether-ketones (PEEK), thermoset materials such as rubber and epoxy, ceramics and hardwoods. Any desired material may be used for the walls 64 and 66 as long as the melting point of the non-metallic wall is higher than that of the filaments being ultrasonically welded. These non-metallic walls allow for small or no clearance while helping to prevent the accidental welding of the horn to the anvil.

Again referring to FIGS. 5 and 6, the anvil also includes spring loaded slides 70 and 72, which help to constrain the filaments in the filament bundle 14 until the horn 34 sufficiently compresses the filament bundle 14. These spring loaded slides 70 and 72 are made of a non-metallic material to prevent welding the horn to the anvil. As the horn 34 moves down towards the anvil 32, it contacts the spring loaded slides 70 and 72, causing them to also move down, into cavities 74 and 76, thereby compressing springs 78 and 80. The horn stops when the filament bundle is sufficiently compressed between the horn 34 and the anvil base 82. Ultrasonic waves are then emitted. The ultrasonic waves pass from the horn 34, through the filament bundle 14 and into the metallic base 82 of the anvil 32.

The horn 34 includes a shaped area 86 that, when combined with the shape of the anvil 82, forms the weld into the cross-sectional shape of the tuft in the finished toothbrush, in this case round. All edges that run parallel to the filament bundle, such as 84 (and edges 92 and 93 in FIG. 7), are sharp rather than rounded to avoid forming flash caused by the thermoplastic filaments flowing into the space a rounded edge would create. However, edges that run perpendicular to the direction of the filament bundle, such as 85 (and 110 and 112 in FIG. 8), are rounded. Rounding the edges 85, 110 and 112 allows for gradual compression of the filament bundle prior to welding and will also help avoid local energy concentrations across the filament bundle which can cut individual filaments.

Figure 7:
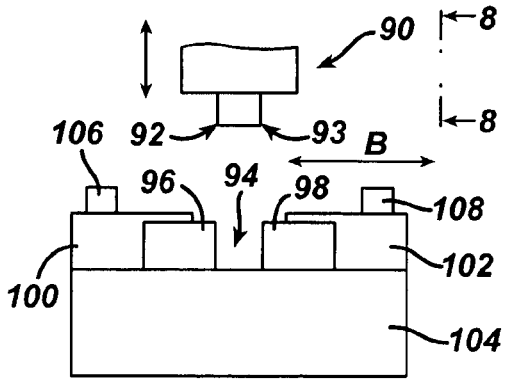
FIG. 7 is a front view of an ultrasonic welding anvil and horn according to another embodiment of the invention.

FIG. 7 shows another embodiment of a horn 90 and anvil 92. This particular embodiment is shaped to make flat nail tufts. The anvil 92 includes a channel 94 through which the filament bundle 14 passes. The channel is lined by Teflon walls 96 and 98. In this embodiment, the width of the channel 94 is adjustable so it can be used with various horns. Teflon walls 96 and 98 are held in place by wall clamps 100 and 102, which are fixed to anvil base 104 by bolts 106 and 108. The bolts 106 and 108 are engaged with nuts that ride in T-slots (not shown) machined into the anvil base 104. To adjust the width of the channel, the bolts 106 and 108 are loosened and wall clamps 100 and 102 can move in either direction indicted by arrow B. Once the correct adjustment has been made, the bolts 106 and 108 are tightened. This adjustment can also be accomplished by advancing the horn 90 into the channel 94, sliding the Teflon walls into contact with the horn, then tightening the bolts while maintaining contact between the walls and the horn.

Figure 8:
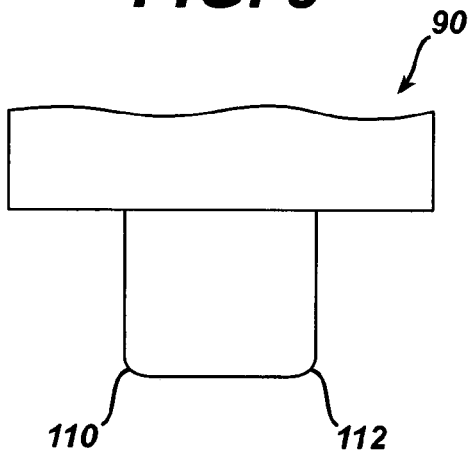
FIG. 8 is a side view of the ultrasonic welding horn of FIG. 7.

FIG. 8 shows the horn 90 from a side view. As can be seen, edges 110 and 112 have been rounded to allow for the gradual compression of the filament bundle prior to welding and to also help avoid local energy concentrations which can cut individual filaments, as described above.

Shaping the Weld

Figure 9:
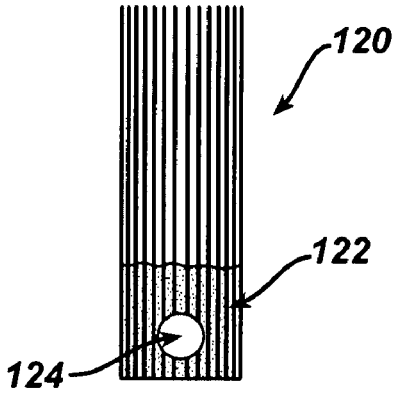
FIG. 9 is a side view of a finished tuft according to an embodiment of the invention.
Figure 10:
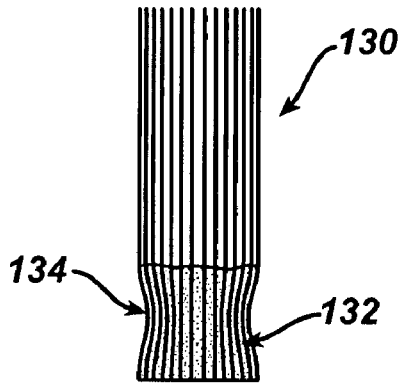
FIG. 10 is a side view of a finished tuft according to another embodiment of the invention.

Referring to FIGS. 9 and 10, the weld can be shaped to help anchor the tuft in the finished toothbrush. Conventionally, prior to molding a toothbrush handle around the tufts extending from the moldbar, the tufts may be melted to fuse the ends together and to give the ends a bulb or mushroom shape. This shape anchors the tuft in the handle by preventing the tuft from sliding out of the handle. A weld made using the present invention can be used to anchor the tufts, eliminating the need for this additional fusing step. FIG. 9 shows a tuft 120 with a weld 122 made by the present invention. The weld 122 includes a hole 124 through the tuft 120. When tuft 120 is in the moldbar, the weld 122 will be in the mold cavity, and as the toothbrush handle is formed, the handle material will flow through the hole 124, thereby anchoring the tuft in place. The hole may be made by adding a point on the horn that will concentrate the ultrasonic waves, thereby creating a hole in the weld. Alternatively, the hole could be formed in a finished weld by another ultrasonic horn or a mechanical punch. Further, the hole can be round, square or any other shape so long as the handle material can flow through to anchor the tuft.

FIG. 10 shows another embodiment of a tuft 130 with a weld 132 made by the present invention. The weld 132 includes an undercut 134 around the entire tuft 130. When tuft 130 is in the moldbar, the weld 132 will be in the mold cavity, and as the toothbrush handle is formed, the handle material will flow around undercut 134, thereby anchoring the tuft in place. This undercut maybe formed by shaping the horn and anvil to compress the filament bundle more in the middle of the weld, thereby giving the final weld a smaller diameter in the middle of the weld.

A number of embodiments of the invention have been described. Nevertheless, it will be understood that various modifications may be made without departing from the spirit and scope of the invention. For example, the shaping blocks 28 and 30 (FIG. 3) are not necessary. The anvil can be designed such that the anvil itself fully shapes the filament bundle. Further, the positions of tensioning device 16 and advancing mechanism 38 can be switched, or both can be on the same side of the welding area 26, either before or after the welding area 26.

Moreover, although, as described above, the spacing of the weld is generally every tuft length T (see FIG. 4), the spacing of the welds may be at an interval equal to X number of tuft lengths. For example, it is possible to weld only every 5 tuft lengths, or 5T. In this example, the welding setup 10 would index the filament bundle a distance equal to 5T for each weld.

Figure 11:
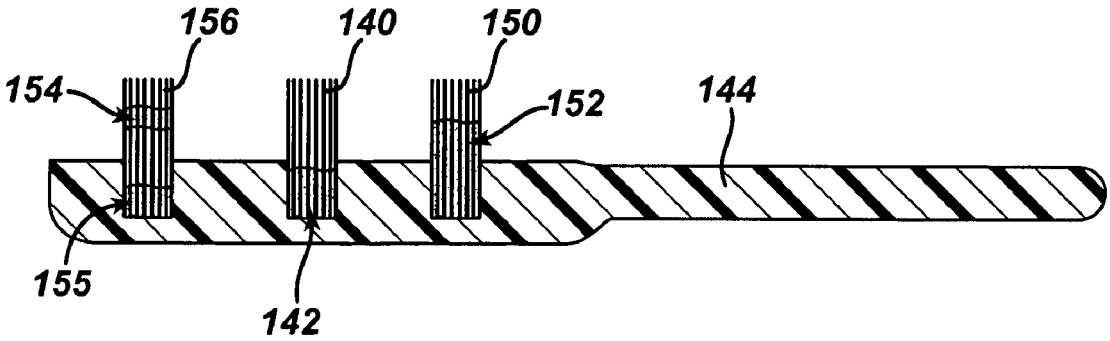
FIG. 11 is cross-sectional view of a toothbrush handle according to one embodiment of the invention.

It is also possible to vary the weld length W (see FIG. 4). Referring to FIG. 11, tuft 140 has a weld 142 that is entirely encapsulated within a toothbrush handle 144. Weld 142 is generally the desirable length for most applications. However, in some cases a longer or shorter weld is desirable. For example, filaments of a diameter smaller than the 0.008 inches described above are sometimes desirable because these thinner filaments can more easily reach in between teeth. However, filaments with diameters less than 0.008 inches tend to more easily bend and quickly wear at the lengths necessary to reach from the toothbrush handle to in between the teeth. This problem can be solved by increasing the weld length to reach beyond the toothbrush handle 144, such as shown by tuft 150 in FIG. 11. Tuft 150 includes a weld 152 that extends from within the toothbrush handle 144 to almost half the length of the free end of the tuft 150. While it is necessary to keep the tuft long to reach in between the teeth, only a portion of the total tuft length actually penetrates into the interdental spaces. Therefore, the rest of the tuft 150 can be welded together to give the smaller filaments structural strength. Alternatively, the distance between welds F (FIG. 4) can be decreased so as to have more than one weld in a tuft length. A fuse in the middle of the tuft 154 would stiffen the tuft 156 while giving a different bending characteristic than the longer weld described above. Further, the fuse in the middle of the tuft 154 can be a different length than the fuse within the handle 155.

Figure 12:
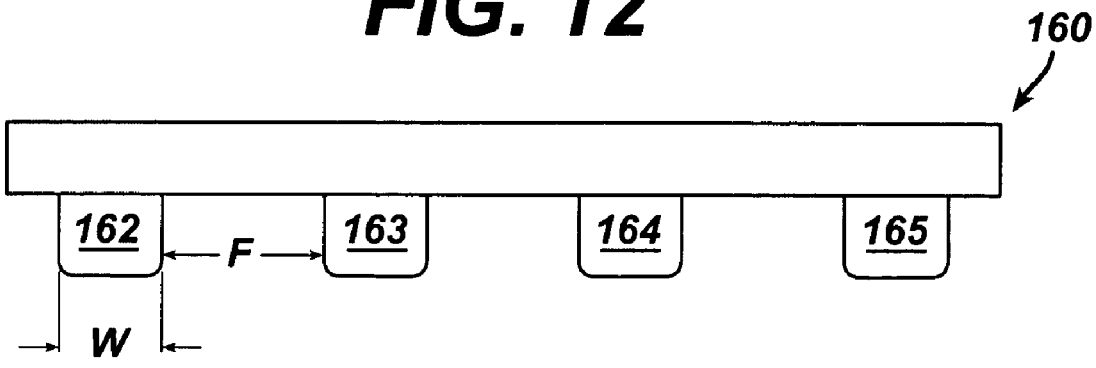
FIG. 12 is a side view of an ultrasonic welding bar horn according to one embodiment of the invention.

Referring to FIG. 12, the welds can also be formed using a bar horn 160. The bar horn 160 has multiple horn tips 162, 163, 164, and 165, which are spaced apart a distance F (see also FIG. 4). The filament bundle would therefore be welded at multiple points at one time. In the example shown, four welds will be made each cycle. This allows the system to index the filament bundle four times farther after each weld cycle, and will therefore cut the time to process a complete spool to 25% of the time it would take using a single horn if all other process parameters remain the same.

Figure 13:
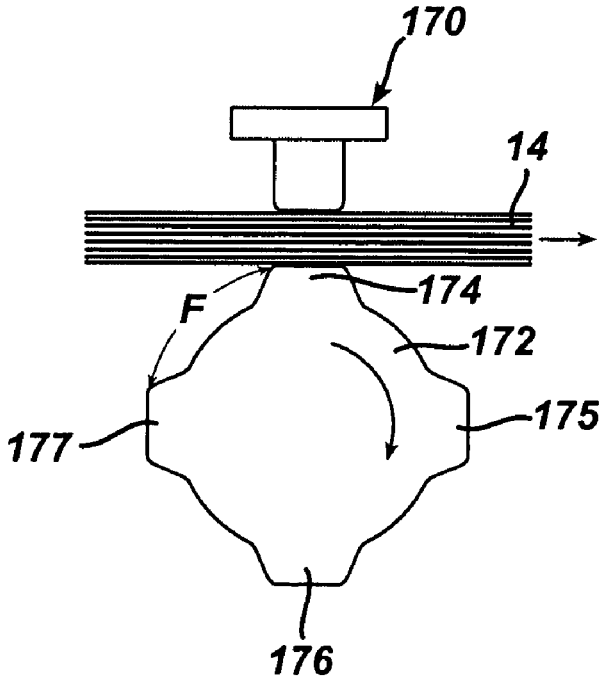
FIG. 13 is a side view of an ultrasonic sewing device according to one embodiment of the invention.

Referring to FIG. 13, ultrasonic sewing may also be used to produce multiple welds on a continuous basis. The filament bundle 14 is pulled at a constant rate through a space between a stationary horn 170 and a rotating anvil 172. The rotating anvil has several high spots 174, 175, 176, and 177, that contact the filament bundle at spaced intervals. The distance between any two high spots would be equal to the free tuft length F. Ultrasonic sewing will allow the process to be continuous and faster than the intermittent indexing, which requires overcoming inertia to move the filament bundle.

Further, the filament bundle 14 can be made up of filaments from multiple spools. The multiple spools may contain filament bundles with fewer filaments, or can even be spools of individual filaments. The filaments combined in the bundle can either be all the same type of filament or different filaments. For example, indicator filaments from one spool can be mixed with non-indicator filaments from another spool. Also, filaments of various colors, materials and diameters can be combined from multiple spools.

Figure 14:
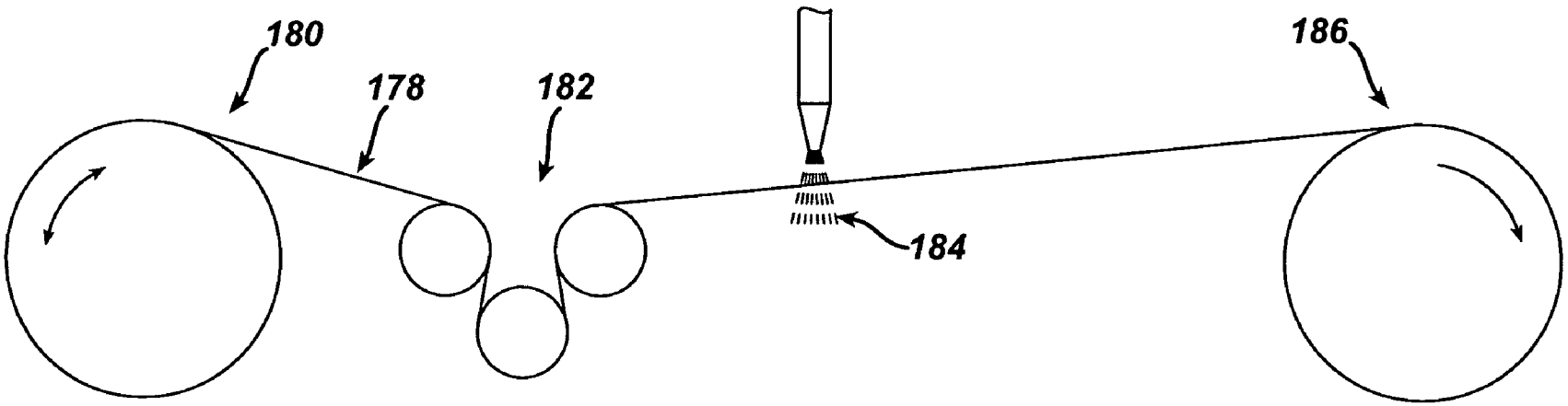
FIG. 14 is a schematic view of a filament bundle bonded according to another embodiment of the invention.

Other methods of bonding the filament bundle together may also be employed. For example, referring to FIG. 14, the filament bundle is impregnated with a soluble adhesive 184 that bonds the individual filaments together. The filament bundle 178 is supplied from a pay-off spool 180 and fed through tensioning device 182. The filament bundle 178 is then passed through a pool or spray of adhesive 184, which is allowed to dry before the bundle is re-wound onto a spool 40. In addition, shaping blocks similar to those in FIG. 3 (28 and 30) may be used one either side of the pool or spray of adhesive 184 to shape the filament cross-section. The filament bundle is then used to make a toothbrush in the tufting machine. After the handle has been formed, the adhesive is dissolved using the appropriate solvent. Preferably, the adhesive is a water soluble adhesive. Alternatively, the adhesive may be applied to the filament bundle just prior to the bundle entering the feeding device. The adhesive may also be dissolved after the filaments are placed in the moldbar, but prior to forming the toothbrush handle.

Figure 15:
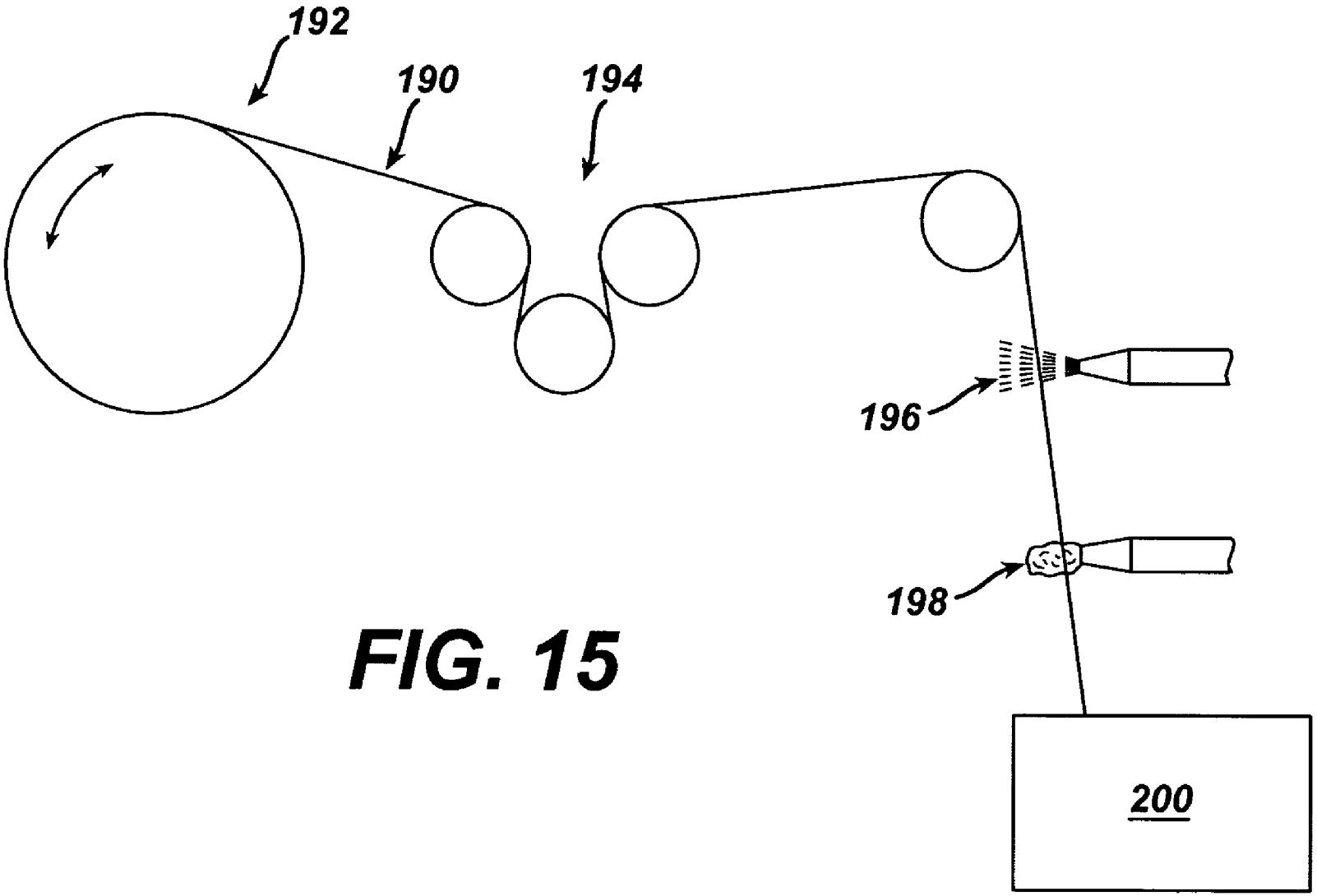
FIG. 15 is a schematic view of a filament bundle bonded according to another embodiment of the invention.

Another method of bonding the filaments is to freeze the filament bundle. Referring to FIG. 15, the filament bundle 190 is supplied from a pay-off spool 192 and fed through tensioning device 194. Water is applied to the filament bundle, either by spraying the water 196 on the bundle, as shown, or by passing the bundle through a pool of water (not shown). In addition, shaping blocks similar to those in FIG. 3 (28 and 30) may be used one either side of the pool or spray of adhesive 184 to shape the filament cross-section. The bundle is then rapidly frozen, which can be accomplished by blasting the bundle with a shot of liquid nitrogen 198, or any other gas or liquid that would cause rapid freezing. Alternatively, the bundle can be pulled through a cooling chamber (not shown) which freezes the water. The frozen rod is then threaded into the feeding device 200. Once the frozen rod is past the feeding device, the ice can be melted. Melting can be accomplished in any desired manner, such as by heating the manifold of the tufting machine, that will not damage the filaments. Melting may also be accomplished through the frictional forces encountered during end rounding.

While the invention has been described by using a toothbrush as an example, it should be understood that any type of brush or article with bristle tufts can be made using the described methods and devices.

Accordingly, other embodiments are within the scope of the following claims.

What is claimed is:

1. A method for manufacturing filament bundles for use in the manufacture of bristle tufts for a toothbrush, the method comprising:

(a) advancing a bundle comprising a plurality of long, continuous strands of filaments through a bonding device in the direction of a longitudinal axis of the bundle, each continuous strand of filament having a first end and a second end;

(b) forming at least one bond between the plurality of continuous strands of filaments, intermediate the first ends and second ends of the filaments, wherein forming the at least one bond between the plurality of continuous strands of filaments prevents the filaments from moving axially with respect to each other;

(c) advancing the bundle further through the bonding device; and (d) forming at least one subsequent bond, axially spaced from the bond formed in step (b) along the longitudinal axis of the bundle to provide an unbonded region between the bonds.

2. The method of claim 1 further comprising forming a plurality of additional bonds spaced axially along the plurality of continuous strands of filaments.

3. The method of claim 2 wherein the plurality of bonds are equally spaced axially along the plurality of continuous strands of filaments, and the method further includes indexing the bundle forward through the bonding device a predetermined distance each time the bundle is advanced.

4. The method of claim 1 wherein the forming step comprises welding the filaments.

5. The method of claim 4 wherein the welding step comprises ultrasonic welding.

6. The method of claim 5 comprising forming the weld using a bonding device comprising a horn and anvil.

7. The method of claim 6 wherein the anvil comprises (a) a metal base;

(b) a channel in the metal base through which the bundle passes; and (b) non-metallic walls lining the sides of the channel, wherein the non-metallic walls prevent the horn from bonding to the anvil.

8. The method of claim 7 wherein the channel in the anvil and the horn together form the bundle into a shape of a final brush tuft.

9. The method of claim 7 wherein the width of the channel is adjustable.

10. The method of claim 6 wherein the bonding device comprises a bar horn and anvil.

11. The method of claim 6 wherein the bonding device comprises an ultrasonic sewing device.

12. The method of claim 1 further comprising shaping the at least one bond to form the bundle into a finished tuft shape.

13. The method of claim 1 further comprising shaping the at least one bond to form an undercut.

14. The method of claim 1 further comprising forming an opening through the bond.

15. The method of claim 1 further comprising tensioning the plurality of continuous strands of filaments before forming the at least one bond.

16. A method for manufacturing filament bundles for use in the manufacture of bristle tufts for a toothbrush, the method comprising:

(a) advancing a bundle comprising a plurality of long, continuous strands of filaments through a bonding device in the direction of a longitudinal axis of the bundle, the filaments being suitable for use in the manufacture of toothbrush bristles;

(b) shaping the bundle to the shape of a tuft on the toothbrush; and (c) forming a plurality of bonds spaced axially along the length of the plurality of continuous strands of filaments, wherein the bonds prevent the filament from moving axially with respect to each other.

17. The method of claim 1 wherein the unbonded region has a length substantially equal to the length of a working, free-end of a tuft on the toothbrush.

18. The method of claim 1 further comprising shaping the bundle to the shape of a tuft on the toothbrush.

19. The method of claim 18 wherein shaping occurs as the bundle passes through the bonding device.

* * * * *